United States Patent [19]

Tolbert

[11] 4,417,861

[45] Nov. 29, 1983

[54] CELL CULTURE PUMPING SYSTEM

[75] Inventor: William R. Tolbert, Manchester, Mo.

[73] Assignee: Monsanto Company, St. Louis, Mo.

[21] Appl. No.: 334,341

[22] Filed: Dec. 24, 1981

Related U.S. Application Data

[63] Continuation-in-part of Ser. No. 291,216, Aug. 10, 1981.

[51] Int. Cl.[3] ..... F04B 21/02

[52] U.S. Cl. ..... 417/315; 417/383; 417/478; 137/269.5; 137/516.27; 137/534

[58] Field of Search ..... 137/516.25, 516.27, 137/533, 534, 269.5; 417/315, 478

[56] References Cited

U.S. PATENT DOCUMENTS

| | | | |
|---|---|---|---|
| 247,142 | 9/1881 | Woods | 417/478 |
| 1,686,310 | 10/1928 | Beebe | 137/516.25 |
| 2,679,861 | 6/1954 | Campbell | 137/516.25 |
| 3,017,871 | 1/1962 | McKiney | 137/516.25 |
| 3,406,633 | 10/1968 | Schomburg | 417/394 |
| 3,457,949 | 7/1969 | Coulter | 137/516.27 |
| 3,551,076 | 12/1970 | Wilson | 417/478 X |
| 3,568,214 | 3/1971 | Goldschmied | 3/1 |
| 3,639,084 | 2/1972 | Goldhaber | 417/394 |
| 3,814,547 | 6/1974 | Kitrilakis et al. | 417/383 |
| 3,883,272 | 5/1975 | Puckett | 417/383 |

FOREIGN PATENT DOCUMENTS

| | | | |
|---|---|---|---|
| 655049 | 7/1951 | United Kingdom | 137/533 |

OTHER PUBLICATIONS

Bregman et al., *Ann. Thoracic Surg.* 24 (6), 574–581, (1977). See FIG. 1, p. 575.

Ask et al., *Amer. J. Physiol.* 233 (5), E389–E396 (1977), See FIG. 1, p. E391 and FIG. 5, p. E392.

*Primary Examiner*—Leonard E. Smith

*Attorney, Agent, or Firm*—Scott J. Meyer; James W. Williams, Jr.

[57] ABSTRACT

A low trauma, reversible flow pumping system is disclosed which is useful for transfer of biological fluids containing fragile components such as cells. The pumping system comprises a length of collapsible and flexible tubing in fluid communication at each end with a two-way, gravity actuated check valve means having a self-centering, vertically slidable weight member for directional regulation of fluid flow. Said tubing is sealingly enclosed within a hydraulic fluid containing chamber which is in fluid communication with oscillatory pressure providing means to cause alternate expansion and contraction of said tubing.

5 Claims, 4 Drawing Figures

CELL CULTURE PUMPING SYSTEM

CROSS-REFERENCE TO RELATED APPLICATION

This is a continuation-in-part of copending application Ser. No. 291,216, filed Aug. 10, 1981.

BACKGROUND OF THE INVENTION

This invention relates to a low trauma, reversible flow pumping system with an improved two-way, gravity actuated check valve means for transfer of biological fluids containing fragile components such as cell culture suspensions and blood or biohazardous materials which require high containment levels.

Pump transfer of biological fluids that contain fragile components or of fluids that are an environmental hazard present special problems. Most conventional pumping systems exert high shear and grinding action on fluid components and/or do not provide complete containment in the event of mechanical failure. Sterilization and maintenance of absolute sterility is also difficult with many pump types. Thus, the conventional impeller driven, gear and piston type pumps produce damage to fragile components and are difficult to sterilize. For such reasons, they are rarely used for transfer of mammalian cell culture suspensions or blood which contain fragile cellular elements.

Diaphragm, bellows and peristaltic type pumps produce less trauma, but present a major problem of leakage if a mechanical failure occurs. Mechanical failures can be expected to eventually occur in such systems due to the stretching and frictional wear of elastic components. Also, the diaphragm and bellows type pumps do not provide a confined flow path, and regions of these pumps can become filled with particulate matter if fluid containing suspended material is transferred such as cell culture suspensions.

Although peristaltic type pumps in which the pumped fluid does not contact any part of the pump mechanism are generally used for the transfer of biological fluids which contain fragile components, certain elastic tube or balloon type pumping systems have been developed heretofor to provide a more gentle pulsatile flow under sterile conditions. U.S. Pat. Nos. 3,406,633; 3,568,214; 3,639,084; and 3,883,272 illustrate such pumping systems in medical applications. In these devices, the alternate expansion and contraction of an elastic tube or balloon element under the influence of oscillatory pressure provides a gentle pulsatile flow of fluid through the elastic element. However, for medical applications the pumps are unidirectional and insofar as the expandable pump elements are elastic, they are subject to eventual rupture or other such mechanical failure.

In said copending application Ser. No. 291,216, a low trauma, reversible flow pumping system is disclosed which is useful for transfer of such biological fluids containing fragile components and for biohazardous materials which require high containment levels. The pumping system comprises a length of collapsible and flexible tubing having inlet and outlet means at opposite ends, each said end being in fluid communication with a two-way, gravity actuated check valve means to permit fluid to be pumped through said tubing in either direction, said tubing being sealingly enclosed within a hydraulic fluid containing chamber and said chamber being in fluid communication with oscillatory pressure providing means to provide alternate expansion and collapsing of said collapsible and flexible tubing. This pumping system produces minimal trauma to fragile components of the pumped liquid. The direction of flow in the pumped circuit can be readily reversed by inverting the pump head and its check valves. The reverse flow is particularly useful in cell culture systems in which it is desired to unclog lines which may have become plugged with cellular matter, to provide backflow of microcarrier particles which are used in some cell culture systems and to avoid product loss during changeover of individual vessels in the cell culture system such as filter vessels and the like.

In each two-way, gravity actuated check valve of said copending application Ser. No. 291,216, provision is made for vertical movement of an elongated slidable weight member between upper and lower beveled seats within a cylindrical chamber. During operation of the pumping system, gravity holds the slidable weight member of the lower check valve in a sealing position against the lower beveled seat and thereby allows fluid in the pump head zone to be pressure pumped in an upward direction through the upper check valve and simultaneously prevents fluid flow in the downward direction. The direction of flow can be readily changed by inversion of the pump head and the two check valves.

BRIEF DESCRIPTION OF THE INVENTION

In accordance with the present invention an improved two-way, gravity actuated check valve means is provided which is adaptable for use in the low trauma, reversible pumping system of said copending application Ser. No. 291,216.

A principal requirement for the pumping system of said copending application is a gentle acting, gravity actuated check valve means which maintains flow through the pump in the desired direction. Two such check valves are required, one above and one below the pump head chamber. As already stated above, a major advantage of such two-way, gravity actuated check valve is that fluid flow is permitted in the upward direction and a simple inversion of the pump head and check valve combination provides a convenient and ready change in direction of fluid flow in the external pumping circuit.

Another major advantage of said pumping system is that it has a very gentle or low trauma action on the pumped fluid and any particulate matter in suspension such as cells, cell aggregates or cell microcarriers. The degree of gentleness is determined directly in the function of the check valve during its closing and opening operations. The heavier the slidable weight required to provide sealing action against the lower check valve, the less gentle is the function of the check valve.

In accordance with the present invention, the improved two-way, gravity actuated check valve means in the aforesaid pumping system is provided with a slidable weight member having significantly less weight for a given fluid pumping rate or pressure than the slidable weight member of said copending application Ser. No. 291,216. Consequently, the improvement defined herein allows for a more gentle pumping action on fragile cellular components of the pumped fluid.

In the check valve described in said copending application, the center of gravity of the slidable weight member is above the sealing position and, thereby, tends to form a classical, unstable equilibrium under certain conditions. That is, the slidable weight member stands upon its sealing position and slight perturbations tend to cause it to fall out of alignment. This tendency to fall out of alignment is moderated by provision of guide members. However, the diameter of the guide members must be less than that of the interior wall of the valve housing to allow free sliding movement and, hence, optimum alignment is not readily maintained.

In the improved two-way, gravity actuated check valve means of the pumping system defined and claimed herein, the slidable weight member is suspended downwardly from its sealing position with its center of gravity below said position. Such configuration provides for a stable equilibrium in the sealing function of the valve. That is, slight perturbations result in self-centering of the slidable weight member and return of its center of gravity to the vertical position. Hence, guide members are not required for optimum alignment.

Another feature of the slidable weight member is that it should be of sufficient weight and shape to prevent its upward displacement in the permitted direction of fluid flow so that its opposite end does not seal against the corresponding seat. With the check valve of said copending application Ser. No. 291,216, such requirement can be attained by increasing the weight of the slidable weight member with increased flow rates. However, such increases in weight tend to compromise the desired gentleness of the check valve. In the check valve means employed in the present invention, an auxiliary weight and/or a spacer ring can be used at opposite ends of the slidable weight member to limit displacement of said member without compromising the gentle action of the check valve means.

DETAILED DESCRIPTION OF THE INVENTION

While the specification concludes with claims particularly pointing out and distinctly claiming the subject matter regarded as forming the present invention, it is believed that the invention will be better understood from the following exemplary description taken in connection with the accompanying drawings in which:

Figure 1:
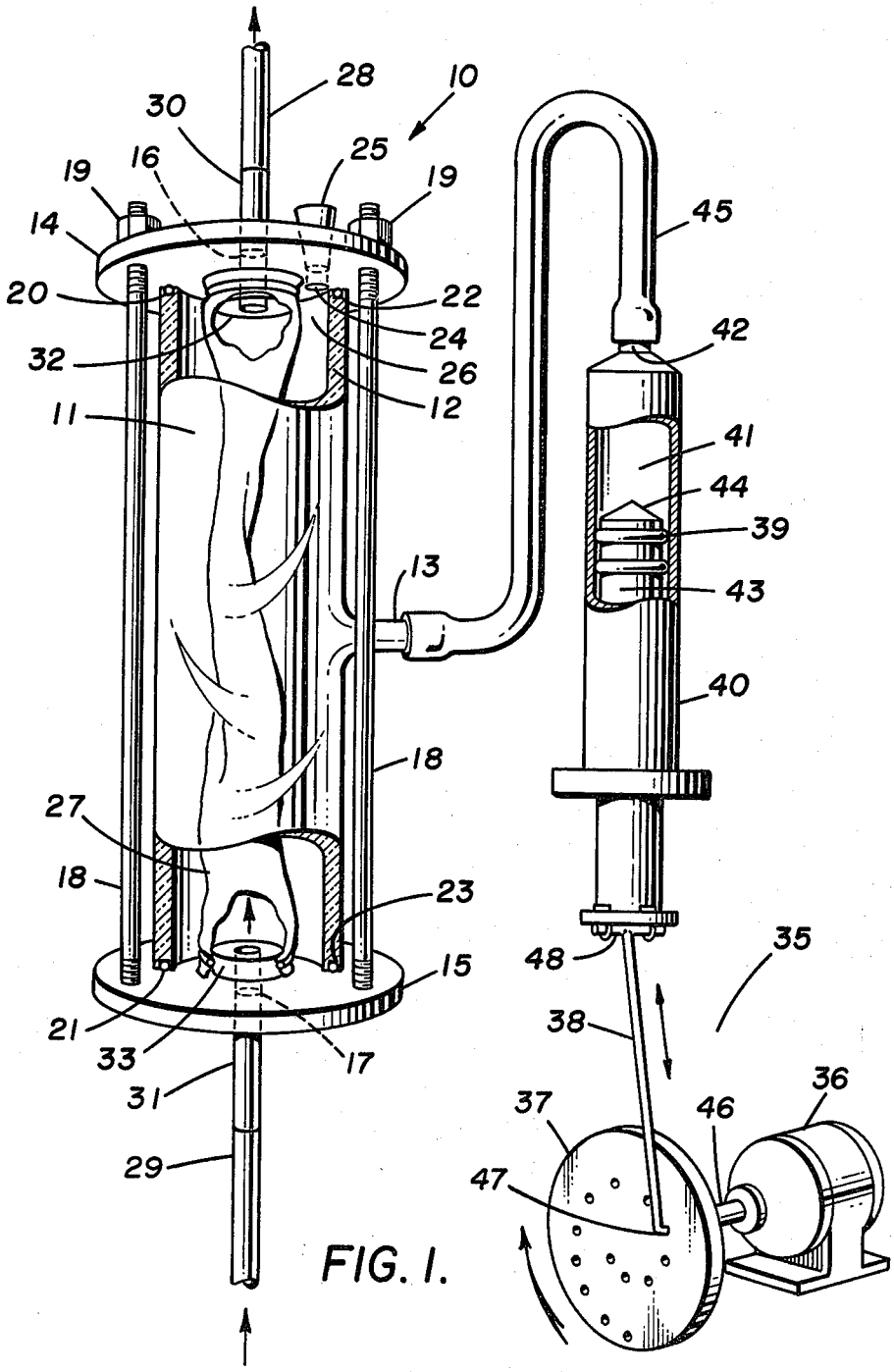
FIG. 1 is a perspective view, partially in cross section, of the low trauma, reversible flow pumping system in a preferred embodiment.

Turning now to the figures, and especially to FIG. 1, reference numeral 10 refers generally to a pump head which is adapted for two-way flow of biological fluids with minimal trauma to cellular or other such fragile components. Pump head 10 comprises a cylindrical chamber 11 having sidewall 12, a side port through tubular arm 13, a pair of disc shaped end plates 14 and 15 and upper and lower ports 16 and 17.

The end plates 14 and 15 are compressibly fastened to chamber 11 by a plurality of vertically-disposed rods 18 inserted through openings in the end plates and tightened down with a corresponding plurality of nuts 19 on threaded ends of the rods. Preferably, three rods 18 are equidistantly spaced apart circumferentially about chamber 11. The end plates seal against chamber 11 by compression of a pair of elastomeric O-ring seals 20 and 21 into annular grooves 22 and 23 in the edges of the chamber sidewall 12. Upper end plate 14 is provided with an additional port 24 for placement of stopper 25 and whereby the chamber can be filled with hydraulic fluid 26 which can be water or other such incompressible liquid.

A length of collapsible and flexible tubing 27 is sealingly enclosed within chamber 11 and adapted for fluid communication with two-way gravity actuated check valves 28 and 29 through ports 16 and 17. Hollow stub shafts 30 and 31 welded into ports 16 and 17 of chamber 11 are positioned intermediate the tubing 27 and valves 28 and 29 to facilitate this fluid communication. Tubing 27 can be sealingly fastened to the stub shafts such as by a pair of tightly fitting rubber grommets 32 and 33 or by other such fluid sealing means. Penrose latex drainage tubing and Gooch gum rubber tubing are useful liquid impervious materials for tubing 27 and are readily collapsible from cylindrical to flat shapes and expandable back to the cylindrical shape. By way of example, Davol® Penrose drain tubing (latex) having an inner diameter of about $\frac{5}{8}$ inch (ca. 1.6 cm) and a wall thickness of less than one mm (Cat. No. H-41533-91204) is eminently suitable for tubing 27. Various liquid impervious plastic and thin metal foil tubing also can be used.

Pump head 10 is coupled to a pump motor and drive unit, designated generally by reference numeral 35. The pump motor and drive unit comprises a variable speed drive motor 36, a rotating plate 37, drive rod 38 and piston cylinder 39. The piston cylinder is provided with cylinder wall 40, a bore 41, upper port 42, slidable plunger 43 and an elastomeric plunger head 44. The bore of the piston is in fluid communication with chamber 11 of the pump head through a non-collapsible, flexible tube 45 which joins piston cylinder port 42 and the chamber arm 13. For convenience, a conventional syringe barrel and plunger can be used as the piston cylinder. The rotating plate 37 which is centered on shaft 46 of the motor is shown to be provided with holes at various radii to accomodate differing positions of the L-shaped end 47 of drive rod 38 and thereby provide various amplitudes in the oscillation of the piston plunger. The T-bar end 48 of the drive rod can be attached to the piston plunger by wires, bolts or other such conventional fastening means.

Tube 45 should have a wall of sufficient thickness to conduct the required pressure changes from the piston cylinder to the pump head chamber. The pumping generally will operate within the range of from about 15 pounds per square inch of negative pressure to about 15 pounds per square inch of positive pressure or within a total pressure differential of about 30 psi. By way of example, standard medical grade silicone tubing having an inner diameter of about 0.1925 inch and an outer diameter of about 0.3920 inch available from Cole-Parmer Instrument Company (Cat. No. C-6411-45) is eminently suitable for tube 45.

Figure 4:
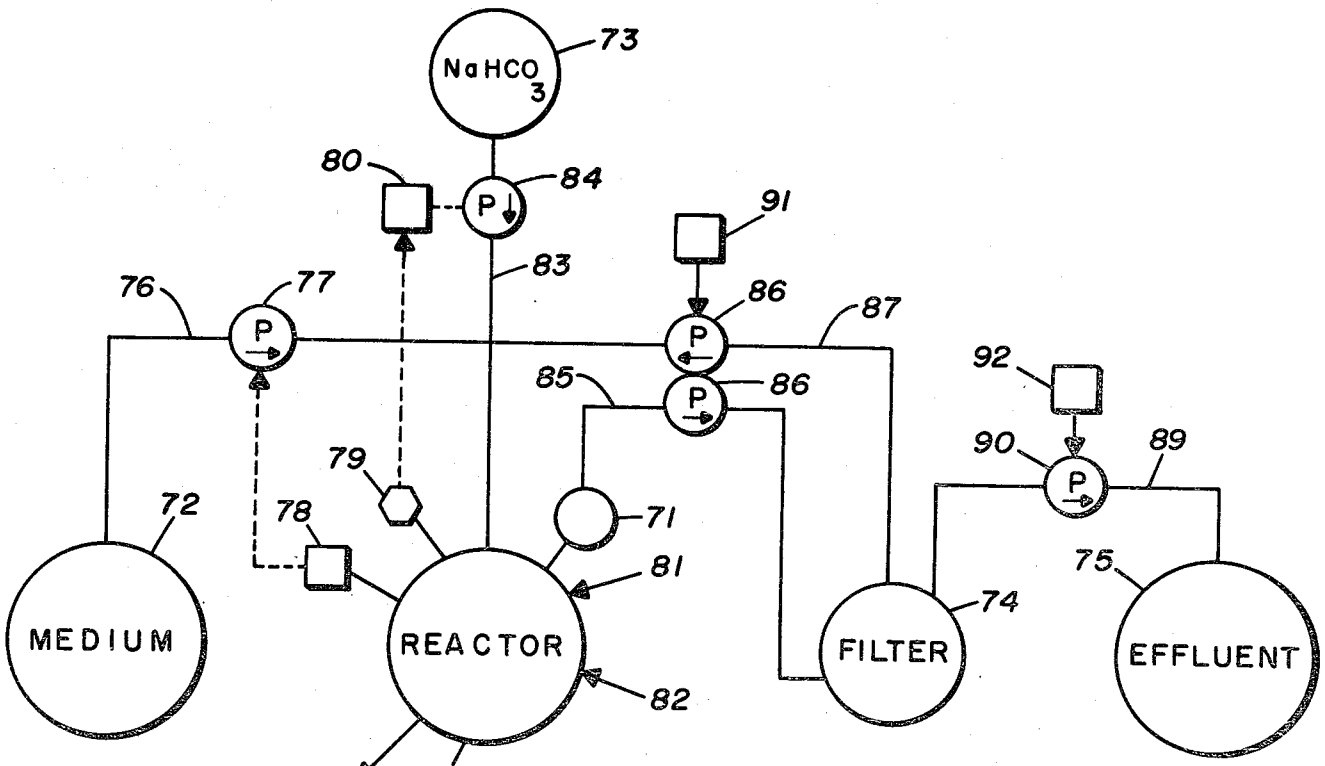
FIG. 4 is a schematic diagram showing the reversible pumping system of FIG. 1 used in an integrated cell culture system.

For some applications, tube 45 can have a Y-shaped configuration in which the piston cylinder is in fluid communication with two pump heads 10 which can be operated jointly for coordinated pumping action or operated separately by pinching closed one arm of the Y (illustrated in FIG. 4). In still other applications, drive rod 38 can be coupled to two piston cylinders 39 which can be a pair of syringe barrels and plunger units each leading to a respective pump head 10. In the latter configuration, two plungers 43 can be coupled to an extended length of the T-bar end 48 of the drive rod.

The various parts of the pump head, check valves and piston cylinder which contact cells and other biological materials to be pumped in the system preferably are made of stainless steel, glass and plastic materials which are autoclavable or sterilizible and non-toxic to such cells and biological materials.

Figure 2:
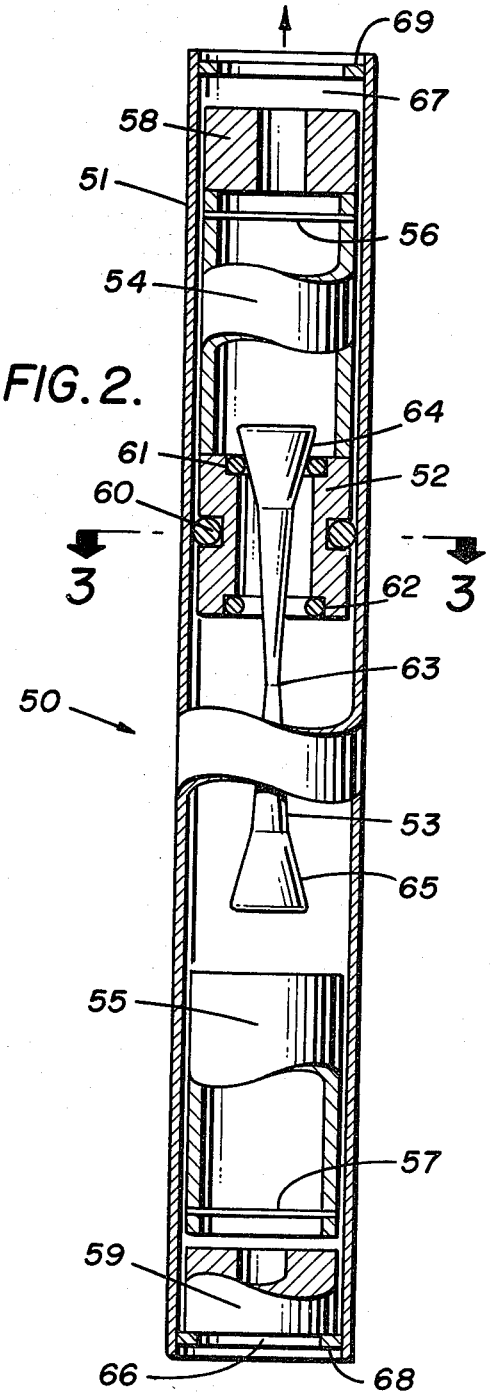
FIG. 2 is a side elevational view, partially in cross-section, showing a two-way, gravity operated check valve used in the pumping system of FIG. 1.
Figure 3:
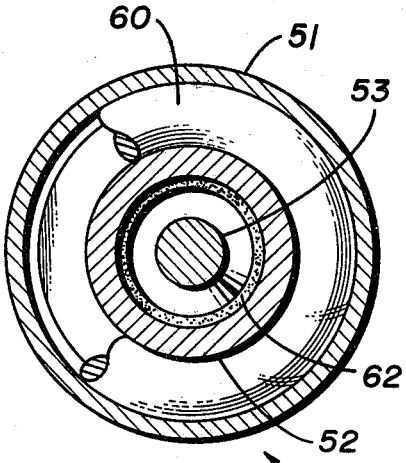
FIG. 3 is an end view taken along the line 3—3 of the check valve of FIG. 2.

An illustrative valve of the two-way gravity actuated check valve means is shown in greater detail in FIG. 2. The check valve, which is indicated generally by reference numeral 50, comprises an outer tubular housing 51, an inner double-ended, centrally disposed cylindrical seal assembly 52 which is concentric with said housing, a centrally disposed slidable weight member 53, a pair of concentric spacer rings 54 and 55 positioned at opposite ends of said seal assembly 52 and provided with corresponding transverse wire 56 and 57, and annular weight members 58 and 59 positioned at opposite ends of said spacer rings. The double-ended, cylindrical seal assembly 52 is inserted into tubular housing 50 and sealed to the latter's inner sidewalls with one or more elastomeric O-ring seals 60 as shown. Seal assembly 52 also is provided with a pair of O-ring seal seats 61 and 62, one in each end of the assembly and facing outwardly in opposite directions.

Slidable weight member 53 is shown to have a generally rodlike configuration with an elongate axis having a length greater than that of the double-ended seal assembly 52, a narrowed central shank portion 63 and outwardly tapering conical ends 64 and 65. The slidable weight member 53 is adapted to vertically penetrate seal assembly 52 along its central axis with the conical ends 64 and 65 adapted for sealingly contacting O-ring seal seats 61 and 62, respectively, to provide the desired sealing action. Conical ends 64 and 65 taper outwardly in opposite directions to seal the opposite ends of the double-ended, seal assembly 52. The narrowed central shank portion 63 of slidable weight member 53 allows free flow of fluid around said member in the proper direction of fluid flow. In manufacture of weight member 53, separate upper and lower halves can be joined to form the central shank portion within the bore of assembly 52.

An important feature of check valve 50 is that the center of gravity of the slidable weight member 53 exists below the upper sealing position. Said center of gravity preferably exists at about or near the narrowed central shank portion 60 and, thereby, enables said member 53 to cooperate with the double-ended seal assembly 52 such as to provide a self-centering action.

The weight of the slidable weight member is desirably maintained at a minimum to prevent damage to cells or other fragile components of the fluid being pumped by the pumping system. However, the weight should be sufficient to provide a sealing contact with the O-ring seal seat and avoid a siphoning effect during operation of the system. In a preferred embodiment in which the tubular housing 51 has an inside diameter of about one-half inch (or about 1.3 cm), a slidable weight member of about 0.2 to about 2 grams provides desirable results.

In operation of the check valve means when the lower check valve is placed in a vertical orientation as shown in FIG. 2, the upper conical end 64 of slidable weight member 53 will rest on O-ring seal seat 61 and whereby close off fluid passage through the valve during the pressure cycle (forward stroke) of the pumping system. In said orientation, the permitted direction of fluid flow above the seal assembly 52 is upward as shown by the arrow. When said check valve is inverted into the opposite vertical orientation, the slidable weight member can fall by gravity such that the opposite end 65 will then rest on O-ring seal seat 62 and close off fluid passage through the valve during the relaxation cycle (reverse stroke) of the pumping system. In either said orientation, the opposite pumping cycle will cause the slidable weight member to rise and thereby open the valve.

The optional spacer rings 54 and 55 with transverse wires 56 and 57 positioned across the ring diameters are adapted to provide a limited upward movement of the slidable weight member. Auxiliary weight members 58 and 59 can be optionally attached to the spacer rings to permit higher fluid flow rates or pressures. The configuration of the spacer rings and auxiliary weights should be such as to allow free flow of fluid and also allow the combination to fall out of position when the check valve is inverted. The lower spacer ring 55 and auxiliary weight 59 fall by gravity in the tubular housing 51 when the check valve is positioned in the vertical orientation shown in FIG. 2. Annular stops or detents 68 and 69 or other such holding means are adapted to limit the fall of the spacer ring and auxiliary weights. Preferably, sufficient vertical space exists in tubing 51 above seal assembly 52 to allow the upper spacer rings and auxiliary weight to similarly fall out of position when inverted from the position shown in FIG. 2.

Two such check valves as illustrated in FIG. 2 are required in the pump system, one above and one below the pump head chamber. Fluid communication between the check valves and pump head chamber can be provided by conventional fluid coupling means such as, e.g., Swagelok® unions. Thus, port 66 or 67 of the check valve shown in FIG. 2 can be in direct communication with pump head 10 of FIG. 1 through port 16 or 17, depending on the relative position of the valve to the pump head.

In operation of the pumping system of this invention, rotary motion from motor 36 is converted to oscillatory motion to drive the piston plunger 43 back and forth against hydraulic fluid 26. The fluid pressure will cause the collapsible and flexible tubing 27 to alternately collapse and expand in accordance with the pressure and relaxation cycles of the piston plunger. As tubing 27 collapses, fluid is forced out of outlet port 16 in each pumping phase, and as tubing 27 expands, fluid passes through inlet port 17 in each filling phase. Reverse flow can be had by inverting the pump head and the attached check valves. Flexible, non-collapsible tubing 45, e.g. thick wall silicone tubing, facilitates convenient inversion of the pump head relative to the pump motor and drive unit.

The sealed fluid region consisting of the chamber volume of hydraulic fluid 26 exterior to tubing 27 and ahead of piston plunger 43 provides a secondary containment system. This system helps prevent possible leakage of the pumped fluid due to leaks in tubing 27 from contaminating the outside environment.

In cases where any leakage of fluid to be pumped through tubing 27 would not constitute an environmental hazard, tubing 27 can be comprised of a semipermeable material such as cellulose dialysis tubing, whereby the pump head 10 can then function as a dialysis chamber without a secondary containment system. Such embodiment would allow pumping of small molecules such as salts and urea from the pumped fluid to diffuse into the sealed chamber liquid (e.g. hydraulic fluid 26) while retaining large molecules and particulate matter such as protein and cells. The fluid in the chamber or dialysate can be periodically changed to maintain a desired concentration gradient for small molecules across the semipermeable membrane.

The pumping system of this invention is particularly useful in an integrated cell culture system as illustrated in FIG. 4 of the drawings. Referring now to FIG. 4, a series of interconnected cell culture vessels is shown comprising a main cell culture reactor or growth vessel 70, a fresh medium reservoir 72, a $NaHCO_3$ reservoir 73, a satellite filter vessel 74 and an effluent reservoir 75. Cells are grown attached to microcarriers in agitated liquid suspension of nutrient medium in the cell culture reactor 70. Additional fresh medium is pumped through line 76 into the cell culture reactor as needed from reservoir 72 by a peristaltic pump 77. A constant liquid level (e.g., 4 liters or 44 liters, depending on the capacity of the reactor) is maintained in reactor 70 by a capacitance level control system 78 attached to the outside of the cell culture reactor and in actuation relation with pump 77. Continuous pH control is provided by an autoclavable pH monitoring electrode 79 submerged in the cell culture reactor 70 through a rubber stopper in a vessel side arm which is connected to a pH controller 80.

A $CO_2$ in air mixture 81 is passed over the cell culture suspension surface in reactor 70 and oxygen 82 is sparged when necessary. Above pH of about 7.1, a high $CO_2$-air mixture (10–15% $CO_2$) flows over the surface of the liquid in the cell culture reactor whereas below pH of about 7.1, a low $CO_2$-air mixture (2–5% $CO_2$) is used. Below pH of about 7.0, an aqueous solution of 0.5 M $NaHCO_3$ is pumped through line 83 into the cell culture reactor from reservoir 73 by a peristaltic pump 84 activated by pH controller 80 as needed to maintain a pH$>$7.0. A low oxygen sparge (about 0–2 ml/minute) is used to maintain a dissolved oxygen level within a range of from about 10 to about 140 mm Hg partial pressure and preferably within a range of from about 30 to about 80 mm Hg partial pressure.

The suspension with cells and microcarriers is periodically removed in part from the main cell culture reactor through a settling chamber 71 where the relatively dense cells and microcarriers are allowed to settle and aggregate during a temporary residence period while the less dense culture medium is pumped through line 85 into satellite filter vessel 74 by the reversible flow pump 86. The culture medium thus flows by pressure differential from below the liquid level in the cell culture reactor through the settling chamber and thence to near the bottom of the satellite filter vessel. Unfiltered medium is periodically pumped through line 87 back into the top of cell culture reactor 70 from near the top of the satellite filter vessel by the reversible flow pump 86. Filtered expended medium is periodically pumped through line 89 into effluent reservoir 75 from the satellite filter vessel by peristaltic pump 90. Pulse timer 91, which is connected to pump 86 regulates the periodicity of circulation of medium between the main cell culture reactor and the satellite filter vessel while pulse timer 92, which is connected to pump 90, regulates the flow of expended medium from the satellite filter vessel to the effluent reservoir. Sampling and harvest of cells from the cell culture reactor at 93 can be had as desired.

The reversible flow pump 86 in FIG. 4 is equipped with one piston cylinder that leads through a Y-shaped tube (as described hereinbefore) to two pump heads, one of which regulates the flow through line 85 and the other of which regulates the flow through line 87 as shown. Each pump head is of the type described herein having a two-way, gravity actuated check valve. The flow in either or both lines can be reversed periodically to adjust the liquid level in the filter vessel or to maintain free movement of microcarrier beads in the narrower portions of the settling bottle as described in co-pending application Ser. No. 181,582, filed Aug. 27, 1980, now U.S. Pat. No. 4,335,215, and assigned to a common assignee.

Various other examples will be apparent to the person skilled in the art after reading the present disclosure without departing form the spirit and scope of the invention and it is intended that all such examples be included within the scope of the appended claims.

What is claimed is:

1. A low trauma, reversible flow pumping system for transfer of biological fluids containing fragile components which comprises a length of collapsible and flexible tubing having inlet and outlet means at opposite ends, each said end being in fluid communication with a two-way, gravity actuated check valve means having disposed therein a self-centering, vertically slidable weight member with a center of gravity below its sealing position and adapted to permit fluid to be pumped through said tubing in either direction, said tubing being sealing enclosed within a hydraulic fluid containing chamber and said chamber being in fluid communication with oscillatory pressure providing means to provide alternate expansion and collapsing of said tubing.

2. The pumping system of claim 1 in which said check valve means comprises an outer housing with inlet and outlet ports, an inner double-ended, cylindrical seal assembly concentric with said housing and having seating means at its opposite ends, a self-centering, centrally disposed elongated slidable weight member adapted to vertically penetrate the bore of said seal assembly, said weight member having a length greater than the length of said seal assembly, conically tapered opposite ends adapted for leak-proof seating on said seal assembly seating means and a center of gravity at about a narrowed shank portion intermediate said conically tapered opposite ends.

3. The pumping system of claim 2 including a spacer ring and an annular weight positioned on each side of said cylindrical seal assembly and concentric therewith.

4. The pumping system of claim 1 in which said flexible tubing is impervious to liquids.

5. The method of transferring a cell culture suspension between interconnected vessels comprising pumping said suspension through a low trauma, reversible flow pumping system positioned intermediate said vessels, said pumping system comprising a length of collapsible and flexible tubing having inlet and outlet means at opposite ends, each said end being in fluid communication with a two-way, gravity actuated check valve means having disposed therein a self-centering, vertically slidable weight member with a center of gravity below its sealing position and adapted to permit fluid to be pumped through said tubing in either direction, said tubing being sealingly enclosed within a hydraulic fluid containing chamber and said chamber being in fluid communication with oscillatory pressure providing means to provide alternate expansion and collapsing of said tubing.

* * * * *